US005343601A

United States Patent [19]

Schippers

[11] Patent Number: 5,343,601

[45] Date of Patent: Sep. 6, 1994

[54] YARN SPINNING METHOD WITH HIGH-SPEED WINDING

[75] Inventor: Heinz Schippers, Remscheid, Fed. Rep. of Germany

[73] Assignee: Barmag AG, Remscheid, Fed. Rep. of Germany

[21] Appl. No.: 966,699

[22] Filed: Oct. 26, 1992

[30] Foreign Application Priority Data

| | | | |
|---|---|---|---|
| Oct. 26, 1991 | [DE] | Fed. Rep. of Germany | 4135350 |
| Dec. 19, 1991 | [DE] | Fed. Rep. of Germany | 4141967 |
| Feb. 4, 1992 | [DE] | Fed. Rep. of Germany | 4203076 |
| Mar. 21, 1992 | [DE] | Fed. Rep. of Germany | 4209235 |
| Jun. 13, 1992 | [DE] | Fed. Rep. of Germany | 4219456 |

[51] Int. Cl.[5] ..... D02G 1/20; D01D 10/04; D01D 10/02; D02J 1/22

[52] U.S. Cl. ..... 28/258; 28/263; 242/43 R; 242/416

[58] Field of Search ..... 242/43 R, 45, 47.08, 242/47.09, 155; 28/258, 240, 245, 246, 263, 265

[56] References Cited

U.S. PATENT DOCUMENTS

| | | | |
|---|---|---|---|
| 3,454,998 | 7/1969 | Satterwhite | 28/258 X |
| 3,601,872 | 8/1971 | Potman et al. | 28/258 X |
| 3,666,154 | 5/1972 | Ishida et al. | 28/240 X |
| 3,861,607 | 1/1975 | Schippers et al. | 242/43 R |
| 3,861,609 | 1/1975 | Klink et al. | 242/45 |
| 4,118,843 | 10/1978 | Schippers et al. | 28/255 |
| 4,274,604 | 6/1981 | Vetterli | 242/45 X |
| 4,484,713 | 11/1984 | Tschentscher | 242/43 R |
| 4,735,370 | 4/1988 | Cowan | 242/45 X |
| 4,902,461 | 2/1990 | Schippers | 264/103 |
| 5,088,168 | 2/1992 | Berger et al. | 28/263 X |

FOREIGN PATENT DOCUMENTS

| | | |
|---|---|---|
| 2204397 | 8/1973 | Fed. Rep. of Germany . |
| 3016662 | 11/1981 | Fed. Rep. of Germany . |
| 58-220807 | 12/1983 | Japan . |
| 58-220809 | 12/1983 | Japan . |
| 623611 | 6/1981 | Switzerland . |

OTHER PUBLICATIONS

Chemiefasern/Textilindustrie, Sep. 1991, pp. 1002, 1004, 1006, 1008.

*Primary Examiner*—Clifford D. Crowder
*Assistant Examiner*—John J. Calvert
*Attorney, Agent, or Firm*—Bell, Seltzer, Park & Gibson

[57] ABSTRACT

A method of processing an endless synthetic yarn is disclosed, wherein the yarn is withdrawn from a spinneret, and advanced into contact with a feed system which is operated under conditions which produce slippage between the feed system and the advancing yarn. As a result, a constant frictional force is exerted on the yarn irrespective of fluctuations of other parameters, and a precisely defined reduction of the yarn tension is achieved which facilitates the subsequent winding of the yarn into a package.

20 Claims, 7 Drawing Sheets

YARN SPINNING METHOD WITH HIGH-SPEED WINDING

BACKGROUND OF THE INVENTION

The present invention relates to a method of forming and processing an advancing endless synthetic filament yarn, and specifically to a method of withdrawing the yarn from a spinneret or a drawing zone by means of a feed system, and then winding the yarn onto a rotating tube to form a yarn package. A method of this type is described, for example, in the trade journal "Chemiefasern/Textilindustrie", September 1991, pp. 1002, 1004. See also DE-A 22 04 397.

The known method is a single-step spinning method for the production of a multifilament yarn, in which the yarn is withdrawn from the spinneret at a high speed by the feed system, and subsequently wound by means of a takeup system. The feed system comprises two godets which are each looped by the yarn at 180°. This means that the yarn tension above the godets starts with a lower withdrawal tension and increases continuously toward the draw rolls by reason of air friction and other frictional influences until reaching the tension under which the yarn contacts the draw rolls. In this process, the yarn tension is increased such that the freshly spun yarn undergoes a complete or partial drawing. It is, however, undesirable and unsuitable to wind the yarn on the package at the same high tension as well. According to the described method, the two godets have a polished surface which has been hard chrome plated. This generates high frictional resistance between the yarn and the draw roll surface, in respect of both sliding friction and static friction. To achieve the necessary decrease in yarn tension, it is necessary that the spin-takeup apparatus have two godets or godets with a yarn displacement roll so as to achieve an adequate reduction of yarn tension and a good uniformity (Uster value). At delivery speeds in excess of 5000 m/min., in the production of yarns consisting of very thin filaments the known method suffers from the disadvantage that filaments often break, and that the broken filaments can no longer be advanced by the godet, but are entrained by air currents which surround the godet, and are subsequently formed into a lap on the godet. Such a lap results in an interruption of the operation. Likewise, the threading of the yarn is rendered difficult, since the yarn breaks due to the great difference in speed. It is also very difficult to adjust the speeds of the feed system on the one hand and of the takeup system and yarn traverse motion on the other. It is necessary that these speeds are adjustable independently of one another. However, their adjustment relative to each other must be very accurate to prevent tearing or slackening (too low yarn tension). Here, too, there exists a potential for damaging the yarn or interrupting the operation by breaking or forming laps. In particular, it is necessary that the circumferential speed of the yarn takeup package be somewhat lower than the circumferential speed of the feed system. On the other hand, it should not be substantially lower than the geometric sum of circumferential speed of the yarn package and the traverse speed, at which the yarn reciprocates along the package. Finally, in this process it is difficult to set the desired yarn tension at a constant level.

The disadvantages of the above process are avoided by in the so-called godet-free spinning. In this process, the yarn is directly withdrawn from the spinneret directly by the yarn takeup package. However, this results in the disadvantage that between the spinneret and the takeup the yarn is subjected to the tension required for fully or partially drawing the yarn. The tension under which the yarn is wound is thus still higher than the tension necessary for the drawing operation. Consequently, a godet-free spinning is possible only with such takeup systems which have an integrated godet for decreasing tension. In this respect, reference may be made to the takeup system disclosed in DE-C 23 45 898 and U.S. Pat. No. 3,861,607. In these takeup machines, the yarn loops about a grooved roll, which is part of the yarn traversing system, at an angle of 60° to 120° before advancing onto the package. This grooved roll may be operated at a circumferential speed which is greater than the circumferential speed of the package, thereby making it possible to decrease the yarn tension and to spin without godets. As a result, such yarn winding machines have become successful in the godet-free spinning process.

In the yarn winding apparatus as disclosed in German Patent DE 30 16 662, the same effect may be achieved in that the yarn advances first via a yarn traversing system, and over a smooth roll which may rotate at a higher circumferential speed than the takeup package, and finally via a second yarn traversing system to the package. Since this system uses a smooth roll, and since the yarn is looped by 180°, there is a risk of laps being formed, and other problems arising from the threading of the yarn. This applies in particular to the adjustment of the roll relative to the speed adjustment of package and yarn traversing system.

A common aspect of the known processes is that they are based on the attempt to obtain in one operating step fully or partially oriented yarns (FOY or POY), while avoiding a buildup of high yarn tensions on the package. Although a godet would be suitable for such a purpose, it entails problems of the kind noted above.

It is accordingly an object of the present invention to provide a yarn processing method of the described type, and which achieves the desired decrease of the yarn tension before the yarn enters into the takeup system, while simultaneously avoiding the disadvantages of the known godets.

SUMMARY OF THE INVENTION

In accordance with the present invention, the above and other objects and advantages are achieved in the embodiments illustrated herein by a method of processing an endless synthetic filament yarn, and which includes the steps of advancing the yarn under a relatively high tension and into contact with a feed system, and including looping the advancing yarn about at least a portion of the circumferential periphery of at least one rotating feed roll, selecting the looping angle of the advancing yarn about the at least one feed roll and the circumferential speed thereof such that the circumferential speed is greater than the speed of the yarn at the point it contacts the one feed roll, and such that the yarn slips with respect to the surface of the one feed roll and a frictional force is produced therebetween which is substantially independent of speed, and withdrawing the advancing yarn from the feed system under a relatively low tension and winding the yarn onto a rotatably driven tube to form a yarn package.

In the preferred embodiment, the winding step includes laterally traversing the advancing yarn along the length of the package and so as to form a traversing triangle.

The feed system may comprise one driven roll, or two driven rolls which are arranged one after the other, so that the yarn loops about each of the two rolls at an angle of at least about 45°. The total angle of looping is thus no less than about 90°. In any event, it should be less than 360°, and preferably less than 270°. The fact of the feed system being driven at a circumferential speed which is higher than the speed of the yarn advancing to the feed system, results in a speed difference and in slippage between the surface of the feed system and the yarn, and thus in sliding friction. It has been found, that in the case of a speed difference, the coefficient of friction of the sliding friction as a function of the degree of slippage changes to some extent abruptly and unpredictably. For this reason, godets and feed systems, as regards their frictional behavior, have conventionally been provided with suitable surfaces and wound by as many loops of yarn as necessary to avoid sliding friction. However, when the speed difference or slippage amounts to at least 3%, preferably more than 5%, and the looping angle is correspondingly adjusted in the specified range, it has unexpectedly been found to be possible to achieve a frictional behavior of the yarn relative to the surface of the feed system which corresponds practically to the frictional behavior of a body in dry sliding friction.

The frictional behavior of a body under dry sliding friction is characterized in that the coefficient of sliding friction is smaller than the coefficient of static friction, and further that the coefficient of sliding friction is independent the speed. This means that the force of resistance which is operative on a moved body, is independent of speed and therefore reproducible. In terms of the invention, this means that a constant frictional force is always operative on the yarn irrespective of the fluctuations of slippage, which leads to a precisely defined reduction of the yarn tension. Consequently, the decrease in yarn tension becomes independent of the yarn speed and thus of the relative speed of the yarn on the surface of the feed system. The importance of the present invention is to have recognized that this independence is necessary for a slip feed system which is intended to decrease the yarn tension, and further that in such a feed system there exists a range of slippage in which this independence exists. As a result, it is accomplished that while on the one hand the yarn tension is clearly reduced, the speed adjustment of the feed system is totally uncritical, as long as it is greater than a specified limit. Contrary to the known processes and the known uses of feed systems and godets, the surface is configured such that it has a small coefficient of friction relative to the yarn. The surface is therefore by no means smooth or polished, but rough or matte. Wear resistant surfaces of this kind, can be produced, for example by plasma coating with metallic oxides. Especially preferred is to also treat the yarn with fluids prior to its entry into the feed system such that the coefficient of friction is low. A coefficient of friction on the order of 0.2 is desirable. In this configuration, the Eytelwein coefficient ($M = \log e^{\mu}$ alpha, where $\mu$ is the coefficient of friction and alpha the looping angle) is not greater than 4, preferably smaller than 3.

A further important characteristic is that the feed system precedes the traversing triangle. The yarn is thus slackened above the stationary yarn guide which forms the apex of the traversing triangle. As is known, the yarn traversing system in which the yarn is reciprocated transversely of its direction of advance at a high speed and in doing so describes a traversing triangle, causes the yarn tension to fluctuate considerably with peaks in the end sections of the yarn traversing stroke system. The proposed method avoids adding the peaks in yarn tension to the high yarn tension existing after the yarn is withdrawn from the spinneret during the drawing process. Consequently, these peaks in yarn tension cannot detrimentally affect the quality of the yarn.

Preferably, the range of the overall looping angle is determined by two criteria. One criterion is an adequate and clear reduction of the yarn tension, and the other criterion is a smooth, troublefree advance of the yarn. However, the size of the looping angle has also an influence, even though not very great, on the amount of the minimum value of slippage which must be predetermined, so as to achieve the desired slip behavior. An overall looping angle of between about 90° and 270° meets this condition.

The speed difference between the speed at which the yarn contacts the feed system and the surface speed of the latter must be so small that a sliding friction develops in any event. In this process, it needs to be considered that, as it contacts the feed system, the yarn is not a solid structure, but it is capable of adapting itself by elongation or shortening to the surface speed of the feed system. It is necessary to avoid this adaptation. The minimum value of the slip will differ from surface to surface of the feed system on the one hand, and from yarn to yarn on the other. However, it has been found by experiments that the difference in speed, i.e., the slip, should be adjusted to at least 3%, preferably to more than 5%. It has further been found that in any event it is possible to obtain a very stable yarn path in the range greater than 3%, and that with a slip from 5% up to 20%, the yarn tension is no longer influenced by the surface speed of the feed system. This means that in this operational range with a slip of more than 3% to 5%, very stable operating conditions are possible with an optimal and constant reduction of the yarn tension. The consequence is that also the yarn speed and thus the yarn quality are constant and no longer influenced by the magnitude of the slip. It has thus shown that in this operational range of the slip, an overall looping angle of 90° leads to a decrease in tension of 30% upon contact of and departure from the feed system, a looping of 135° to a decrease in tension of about 40%, and a looping of 225° to a decrease in tension of 70%. This means that the decrease in the yarn tension is only dependent on the looping angle, and can therefore be regulated in a simple and reproducible manner by the adjustment of the looping angle.

A further treatment of the yarn may occur upstream or downstream of the feed system which serves, primarily the adjustment of a suitable coefficient of sliding friction. For example, the yarn may be moistened with a fluid prior to contacting the feed system.

The method of the present invention is primarily useful to withdraw the filaments of a yarn at a high speed from the spinneret and to subject same to a full or partial drawing in this process. The feed system of the present invention has in this process the advantage that no laps form on it, and that it allows high yarn tensions to be exerted on the yarn for its drawing, while a planned decrease of the yarn tension in the takeup zone is also possible.

In particular in the production of industrial yarns which distinguish themselves not only by their thickness, but also by an especially great strength, it may however be necessary to withdraw the filaments of the yarn from the spinneret, by a slipless, standard godet, i.e. a godet which is looped several times, with a high coefficient of friction, and, if need arises, to draw same in one step or in two steps between two godets. In such an event, it would be necessary to supply the yarn to the winding zone by such a slipless godet which is looped several times, with a high coefficient of friction and with the aforesaid disadvantage that laps form easily on this godet due to the low takeup tension. For this reason, the application of the feed system in accordance with the invention is also useful between such a godet and the stationary yarn guide in the yarn winding zone for purposes of decreasing the yarn tension, since this feed system allows the yarn to be withdrawn by the godet with adequate tension, and fed to the takeup system with a low tension.

It is also proposed to provide a heat treatment between the feed system and the stationary yarn guide which forms the apex of the traversing triangle, for example by a vapor-fed nozzle. Such a method permits the production of, in particular, polyamide yarns at a high speed of more than 3500 m/min. by the high-speed spinning process, and likewise polyester yarns which may be wound in this instance at speeds higher than 5000 m/min. To produce fully oriented yarns, it is recommended to provide for a tubular heater upstream of the feed system, such as is described in U.S. Pat. No. 4,902,461, note also U.S. Pat. No. 3,229,330.

The interposition of the vapor treatment provides the advantage, in particular for nylon, but also for polyester which has been spun at speeds above 5000 m/min., that the tendency to shrinkage resulting from the drawing is released, and such a considerable shrinkage occurs that a good yarn is produced when rated by its strength and shrinking properties.

Finally, it is possible and recommended to provide a so-called entanglement nozzle between the feed system and the stationary yarn guide of the traversing triangle. In this nozzle, an air jet is blown on the yarn transversely of its direction of advance, thereby effecting the formation of individual tangles distributed over the yarn length. This strengthens the coherence of the individual filaments in the yarn.

The method of the present invention is also particularly suitable for the so-called "short spinning" process. In this process, the feed system is arranged at a short distance of less than 2 meters below the spinneret. The yarn is so quickly withdrawn by the feed system that it is adequately cooled along this short distance. At the same time, a high air resistance which acts on the yarn effects, together with the residual heat remaining in the yarn, an almost complete drawing of the yarn. The speeds in this instance are above 7000 m/min.

The surprising discovery which underlies the present invention is that when the slip is increased to values not heretofore practiced, which are above 2%, and preferably however above 3%, the change in the yarn tension downstream of the godet or feed system is no longer dependent on the surface speed of the godet. Therefore, this method permits a very stable operation, since also the tendency of the feed system to cause a breakdown of the operation by filament breaks and/or lap formation is practically eliminated. The amount of the yarn tension however may be clearly and reliably determined with the looping angle. Due to the amount of slip, also the risk of laps forming on the feed system is simultaneously eliminated despite the low yarn tension, at which the yarn leaves the feed system. Thus, a considerable decrease in tension is allowed to occur. In this process, the first godet operates in the range of static friction with the advantage of a reduction of the yarn tension. The second godet effects a further reduction of the yarn tension and a steadying and stabilizing of the operating conditions. Because of the considerable reduction of tension, the method is also particularly suitable for the inclusion of the described aftertreatment processes following the draw process. Therefore, a shrinkage treatment is suggested between the feed system and the stationary yarn guide of the traversing triangle, in which the yarn is subjected to the action of heat, and/or an entanglement treatment, in which an air jet is directed on the yarn transversely to the yarn axis, thereby producing a combination between the individual filaments.

As aforesaid, the method of the present invention distinguishes itself in that it permits the reproducible process parameters to be adjusted, in particular yarn tension and yarn speed. However, while on the one hand cases are conceivable in which greatest accuracy matters, on the other hand cases are also conceivable in which, as a result of changes in the surface condition or changes of the yarn characteristic, long-term operation leads to changes in process parameters and thus also to a change in yarn properties. To eliminate this, it is further proposed to regulate the yarn tension in that the looping angle is adjusted in dependence on the measured yarn tension. The measuring device as used in the process, permits the looping angle to be adjusted at the same time, in that one of the rolls of the feed system, or a further roll preceding the feed system, is arranged for movement under the yarn tension against a spring force such that the looping angle changes along with its movement. This is a further possible embodiment. However, it is also possible to provide a measuring sensor with an adjusting device which changes the relative position of the rolls of the feed system such that the looping angle changes.

The feed system of the present invention further allows novel process variants of the already described short spinning process and the spinning process using a tubular heater to be realized. For example, the yarn may be advanced through a narrow heated table and heated to a temperature above 90° C., prior to passing through the feed system.

Whereas both the short spinning process and the spinning process with a tubular heater have in the past been affected by the disadvantage that the resulting drawn yarns are very susceptible to shrinkage and therefore create considerable problems in the winding of the yarn, the process variant of the present invention permits such shrinkage to be reduced. For example, a shrinkage treatment may be positioned between the feed system and the stationary yarn guide of the traversing triangle, and which involves directing hot or saturated vapor into contact with the advancing yarn.

A further advantageous variant of the process results for the so-called spin texturing process. Spin texturing is known from German Patent DE 26 32 082. In this process, the freshly spun and drawn yarn advances through a hot air or hot vapor nozzle into a tubular stuffer box, where it is compressed to a yarn plug.

The yarn plug is advanced under the impact of the hot air or vapor through the tubular stuffer box, withdrawn therefrom as a yarn plug and wound on a cooling roll. Before leaving the cooling roll, the yarn plug is withdrawn, which leads to considerable fluctuations in the yarn tension. Therefore, it has been difficult to subject the now-crimped yarn to a uniform entanglement treatment, since the fluctuations in the yarn tension led also to different results of the entanglement. Even the interposition of a standard feed roll between the cooling drum and the entanglement nozzle did not remedy the situation, since the feed roll transmits the fluctuating yarn tension.

The above problems associated with the spin texturing process are solved by the process of the present invention. In addition, the use of a further slipfree feed system, or in particular its yarn brake, allows to further stabilize the yarn tension.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
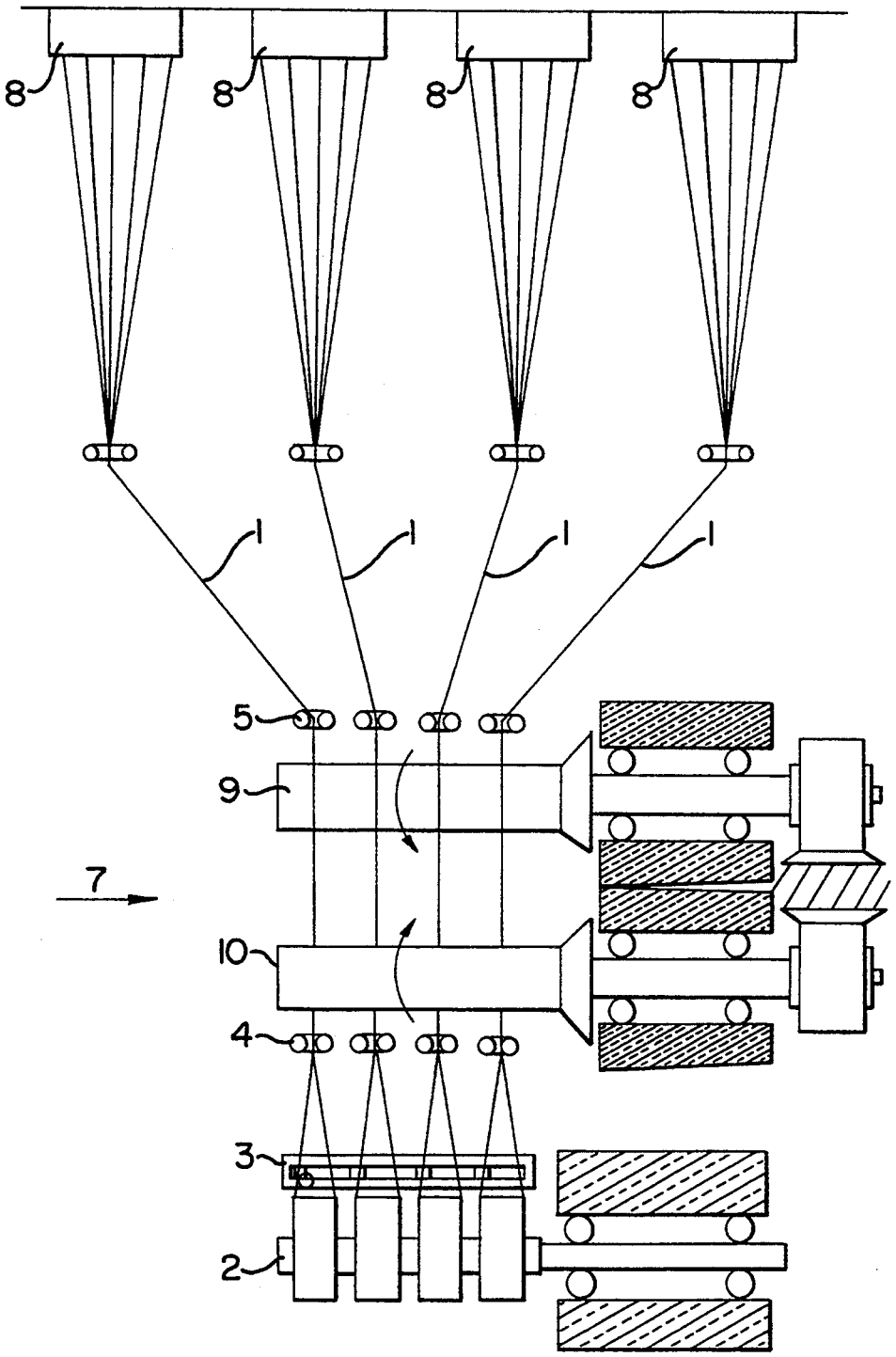
FIG. 1 is a front view of a spinning apparatus which embodies the features of the present invention.
Figure 2:
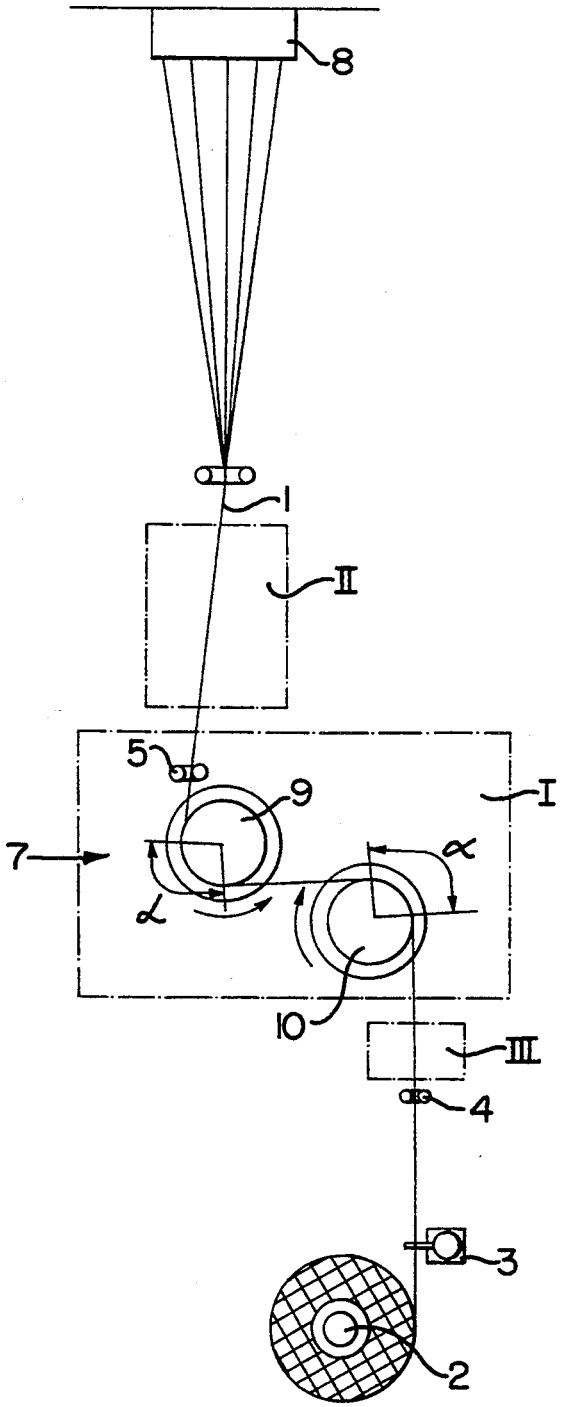
FIG. 2 is a side view of the spinning system.

The embodiment illustrated in FIGS. 1 and 2 includes a spinning system for four yarns I which are each wound onto a winding tube to form a package on a common winding spindle 2. Upstream of the yarn takeup device, a traversing system 3 is arranged which reciprocates each of the yarns along its associated package. As a result of this motion, each of the yarns describes a traversing triangle between a stationary yarn guide 4 and the yarn traversing system 3.

Arranged between collecting yarn guides 5 and stationary yarn guides 4 is a feed system 7. The function of the collecting yarn guides 5 is to reduce the mutual distance between the yarns which first corresponds to the gauge of spinnerets 8, to the gauge of the packages on spindle 2. The feed system 7 extends over the overall distance of the collecting yarn guides 5, and it comprises two rolls 9 and 10 which are arranged parallel to one another and which are offset in height a distance which equals their diameter, as is seen in FIG. 2.

For reasons of clarity of illustration, FIG. 1 shows a greater offset in height, so as to be able to illustrate that there are two rolls 9, 10. The rolls are rotated in opposite directions substantially at the same circumferential speed. They are looped by the yarn at an angle alpha of at least 90°, and they have a coefficient of friction relative to the yarn of, for example, 0.2 to 0.6. The circumferential speed is higher, for example, 3% to 30% than the yarn speed. The yarn speed is determined from the geometrical sum of the constant circumferential speed of the packages and the speed of the yarn traversing system 3.

Figure 9A:
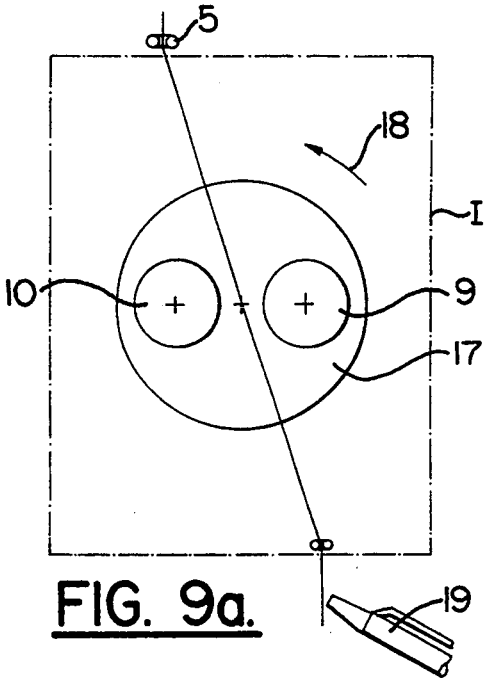
Figure 9B:
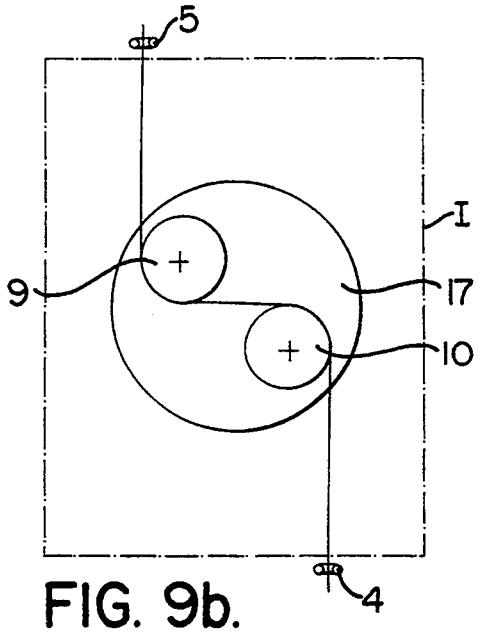

The two rolls 9, 10 of the feed system may be adapted for relative movement with respect to one another, so as to be able to thread the yarn on the winding head without contacting the godets. To this end, the rolls 9, 10 may be supported for rotation on a rotatable support plate 17 (FIGS. 9*a*, 9*b*). It is possible to drive the rolls by one motor with a gear connection, or by two independently controllable motors. Thus, it is possible to adjust the speed of the first roll 9 lower than that of roll 10, so a static friction is present on roll 9, whereas a clear sliding friction with a slip of 3% or greater exists on roll 10.

Figure 10:
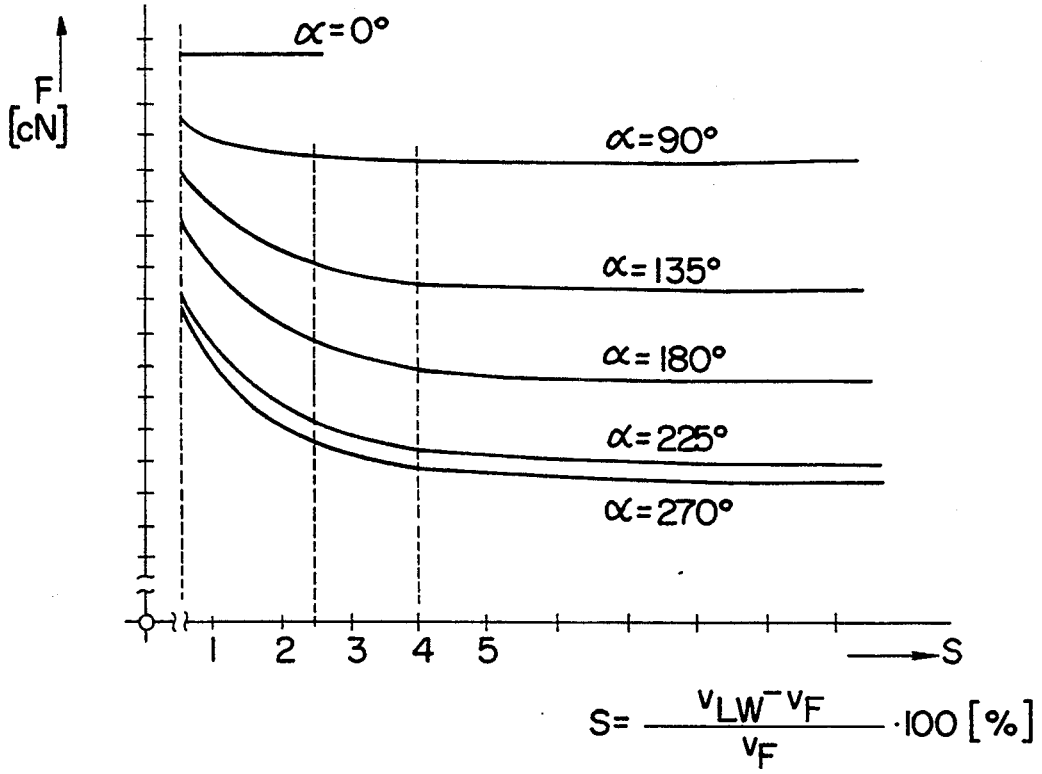
FIG. 10 is a diagram of the yarn tension versus the slip.

Shown in FIG. 10 is a diagram which illustrates the dependency of yarn tension (F) on the slip, which is measured in cN, and develops between feed system 7 and the yarn takeup device. Slip is here defined as the difference between the surface speed ($v_{LW}$) of the feed system 7 less the yarn speed ($v_F$) directly before the feed system, and divided by the mentioned yarn speed ($v_F$).

$$S = \frac{v_{LW} - v_F}{v_F} \cdot 100[\%]$$

When the slip is below a certain value, e.g. less than one percent, the relation between yarn tension and slip cannot be represented practically and reproducibly. When the slip is above that value, an essentially reproducible relationship results, which demonstrates that the yarn tension is dependent on the amount of slip. Only in that range, will it show that the decrease in yarn tension or yarn tensile force is dependent on the looping angle alpha or its sum, at which the yarn loops about the driven rolls of feed system 7. However, it will show in particular that irrespective of this looping at a certain slip which is in the range of 2.5%, it is essentially no longer possible to decrease the yarn tension as the slip increases. For this reason, the operative point of the feed system is placed in a range, in which the yarn tension measured downstream of the feed system is no longer dependent on the amount of slip. There exists now a behavior under sliding friction between the yarn and the surface of the feed system, which corresponds substantially to the behavior under sliding friction in dry friction. In this manner, it becomes possible to produce packages and yarns of great uniformity and quality. On the other hand, there is no risk that filament breaks occur, and that the filaments, broken filaments, or the yarn form laps on the rolls of the feed system.

FIGS. 3–9 show modifications. These modifications relate to the regions I, II, III which are boxed in dashed lines in the drawing of FIG. 2.

Figure 3:
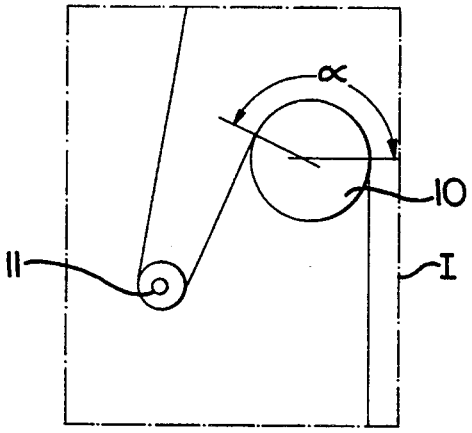
FIGS. 3–9*b* show modifications of the spinning system in accordance with FIGS. 1 and 2.

FIG. 3 illustrates a modification of feed system 7. In this Figure, the feed system comprises a driven roll 10, to which the yarn advances from a freely rotatable guide roll 11. To achieve the advantages of the invention, it is necessary to adjust in this embodiment the looping angle alpha exclusively on the driven roll 10. The slip occurs exclusively on the driven roll 10. The advancing may if desired be moistened, such as by oiling the yarn, at a location upstream of the roll 10, and such that the advancing yarn has a coefficient of friction which is less than about 0.4 with respect to the surface of the roll 10. Also, a driven feed roll could be positioned upstream of the roll 10, with the feed roll having a surface speed which is substantially the same as or up to about 2% greater than the advancing speed of the yarn.

Figure 4:
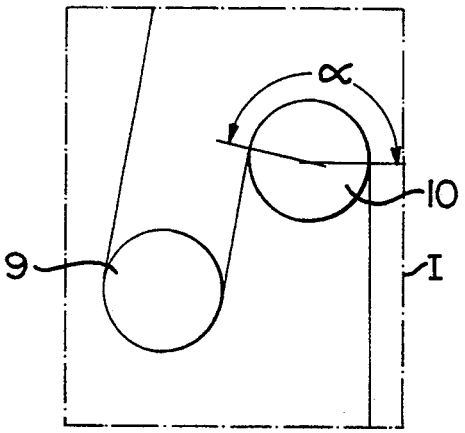

FIG. 4 illustrates a modification of the feed system which consists of two driven rolls 9 and 10. However, the first roll 9 is driven exactly at a circumferential speed which is equal to the yarn speed ($v_F$). It is therefore necessary to adjust on roll the looping angle alpha which is required for the desired decrease of the yarn tension or yarn tensile force. It is roll 10 whose circumferential speed is greater by the desired slip than the yarn speed or the surface speed of the preceding roll 9.

Figure 5:
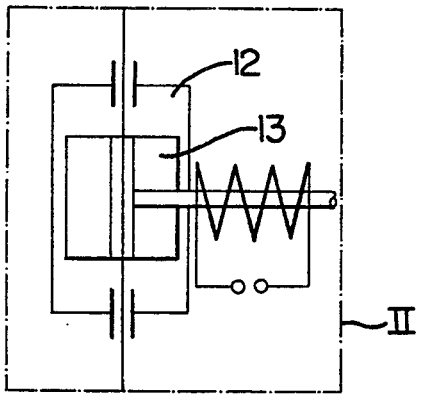
Figure 6:
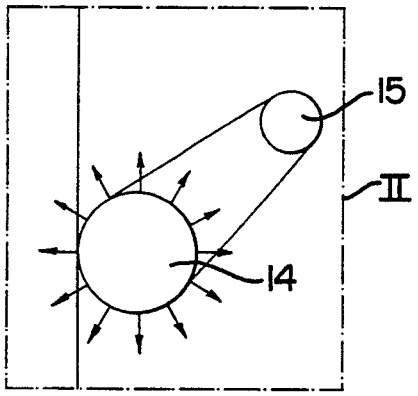

FIGS. 5 and 6 show modifications of the region II upstream of feed system 7 in accordance with the invention. In FIG. 5, a heating system is provided upstream of the feed system. This heating system may be a vapor chamber 12 as is illustrated. Accommodated in this vapor chamber, is a vapor nozzle 13, through which the yarn advances and is supplied with heated or saturated vapor. In the place of this heating system, it is also possible to use a heated plate or a straightened heated tube, through which the yarn advances without contacting it, and in which the yarn is drawn and set. Such a heated tube is described, for example, in DE 38 08 854 A1.

Illustrated in FIG. 6 is a modification of this region II with a heated godet 14 and a guide roll 15 associated thereto. The yarn loops several times about the godet. It operates at a speed which corresponds to the speed at which the yarn is withdrawn from the spinneret. The godet allows to set the withdrawn yarn at a temperature which, depending on the kind of yarn, may range between 90° and 240° C.

Subsequently, the yarn is withdrawn by the downstream feed system of FIG. 2, 3, or 4. In this instance, the surface speed of slip roll 10 is, in accordance with the desired slip (S), above the surface speed of the heated godet 14. This ensures on the one hand that the yarn is reliably withdrawn from the heated godet and does not form laps. On the other hand, however, the yarn tension or tensile force is decreased, as has been described above.

Figure 7:
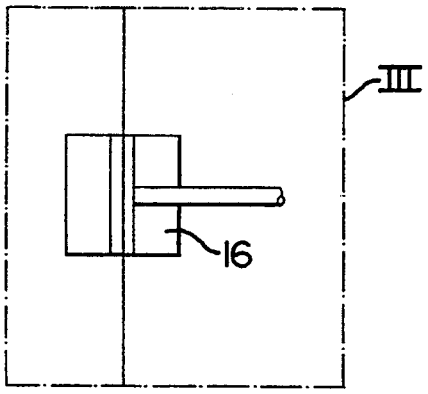
Figure 8:
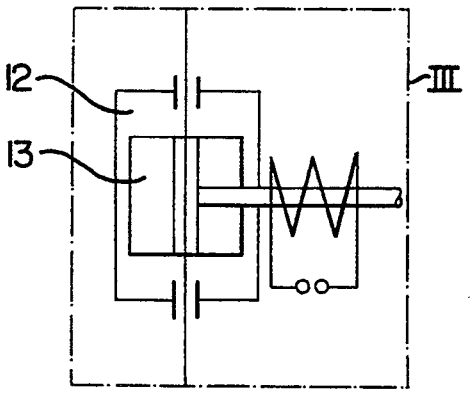

FIGS. 7 and 8 show modifications of the region III between the feed system 7 of the invention and the stationary yarn guide 4.

The modification of FIG. 7 includes an entanglement nozzle 16 in this area. In the entanglement nozzle, the yarn advances through a cylindrical passageway into which an air supply line terminates on its side. An air jet directed on the yarn interlaces the filaments of the yarn continuously or at certain intervals in the form of tangles. This results in a coherence among the filaments, which facilitates winding.

In the modification of FIG. 8, a vapor nozzle with a vapor chamber 12 and nozzle 13 takes the place of the entanglement nozzle. In the yarn duct of nozzle 13, a stream of heated or saturated vapor is directed onto the yarn. Due to the decrease of the tension which has been effected by feed system 7, such a nozzle and vapor treatment chamber allow to perform a shrinkage in a very efficient manner. To this end, a high amount of looping is selected for feed system 7, so that the yarn tension is low in the region III, and the yarn is allowed to shrink accordingly. The vapor treatment may also be replaced with a hot air treatment. As to its usefulness, the latter is dependent on the kind and material of the yarn.

FIGS. 9*a* and 9*b* show a modification of the feed system 7 in region I. In this instance, the feed system comprises two slip rolls 9 and 10. These slip rolls are supported on a rotatable plate 17. Plate 17 can be secured in a threading position where the rolls 9 and 10 do not contact the yarn. It is therefore very simple to thread the yarn with a suction gun 19 on rolls 9 and 10. In this connection, it should be noted that, absent a conveyance by the feed system, the yarn advancing from the spinneret has an undefined speed. It is also possible to withdraw the yarn slowly from the spinneret. Therefore, standard suction guns 19 with only little suction capacity will suffice to withdraw the yarn from spinneret 8 and thread it on the winding head. Only then is plate 17 rotated in direction of arrow 18 to its position shown in FIG. 9*b*. As a result of this rotation, the rolls 9 and 10 come into contact with the yarn. The rotation of turntable 17 may be selected such that the desired overall looping angle alpha is adjusted on both rolls 9 and 10.

Figure 11:
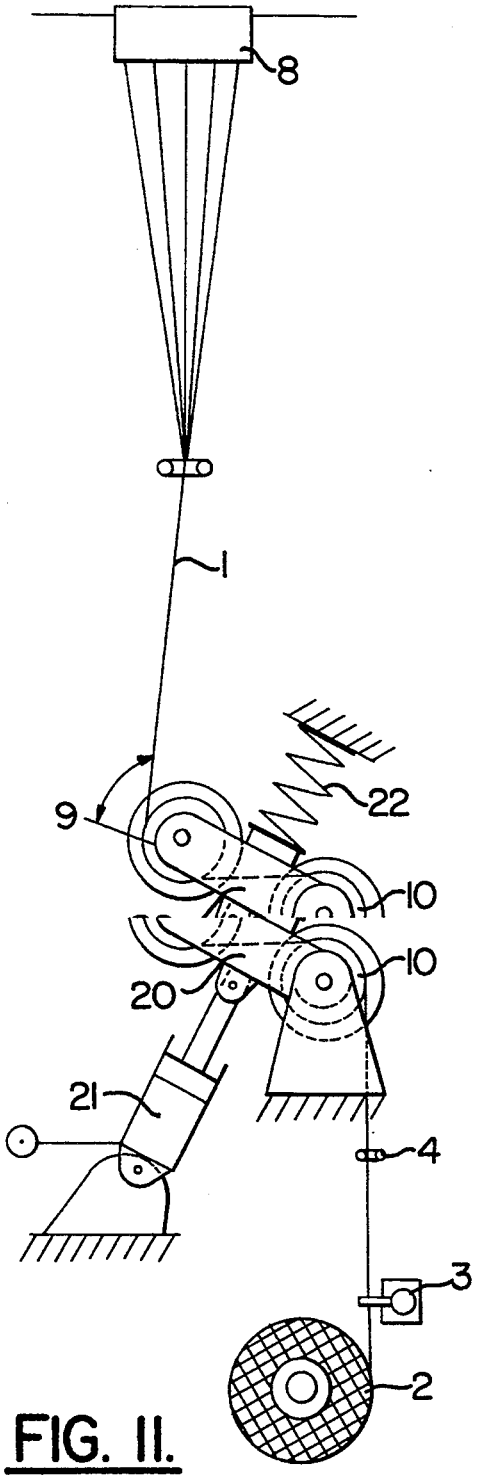
FIGS. 11 and 12 show further modifications for regulating the yarn tension.

Illustrated in FIG. 11 is a modification which is similar to that of the spinning apparatus of FIG. 1. To this extent, the above description of FIG. 1 is incorporated in the following description. In this modification, the roll 9 is rotatably supported at the end of a rocker arm 20 and driven. The rocker arm 20 is rotatable about an axis coaxial to the axis of roll 10. The rocker arm 20 is supported against its weight by a cylinder-piston unit 21 which is biased by a constant pneumatic pressure such that the weight is fully compensated. On its other side, the rocker arm 20 is biased by a spring 22 against the force of cylinder-piston unit 21. The tensile force of the yarn on rocker arm 20 is therefore operative against the force of the spring 22. Consequently, the rocker arm 20 swings as a function of the yarn tensile force. Also, the looping angles alpha on rolls 9 and 10 change simultaneously. At a smaller looping angle, the yarn tension becomes less so that as a matter of its tendency, spring 22 rotates the rocker arm in the direction which increases the looping angle. The reverse will occur, when the yarn tension is reduced. Thus, the rocker arm 20 with roll 9 serves as a yarn tension measuring device on the one hand, further as a device for adjusting the looping angle, and finally, at the same time, as the feed system or a part thereof in accordance with the invention. Although this system requires the movement of large masses, thereby imparting to it a certain inertia, it is however intended to regulate only long-term fluctuations of the yarn tension.

Figure 12:
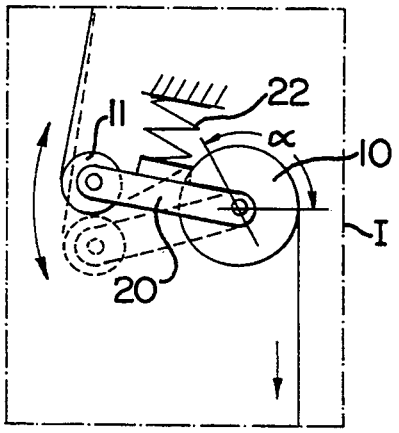

In the modification of FIG. 12, which involves the region I of FIG. 2, the feed system comprises only one roll 10 which is looped by the yarn. As in the modification of FIG. 3, this roll 10 is preceded by a freely rotatable guide roll 11 which determines the looping angle. The guide roll is supported at the end of a rocker arm 20. The rocker arm 20 is rotatable about the axis of roll 10 against the force of a spring 22. Spring 22 is arranged such that it is operative against the torque which the tensile force of the yarn exerts on the rocker arm. In this instance, the guide roll 11 acts as a measuring device for the yarn tension, but simultaneously also as a device for adjusting the looping angle alpha which decreases along with the rotation as the yarn tension becomes larger, and increases as the yarn tension becomes smaller.

Figure 13:
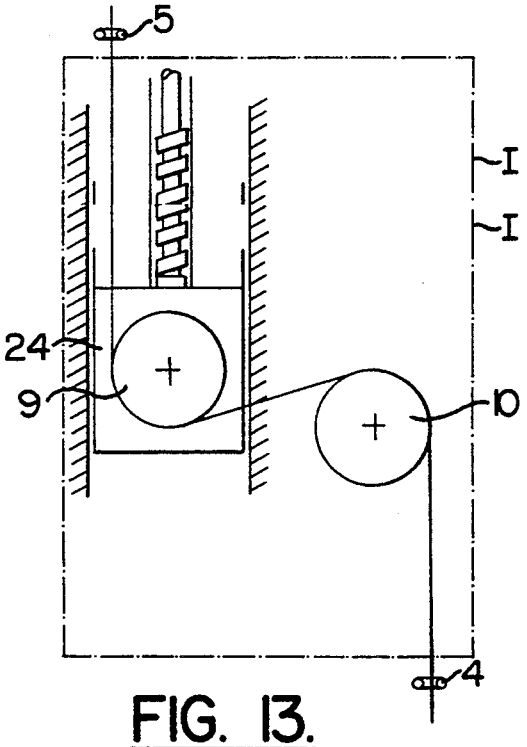
FIG. 13 is a further modification for adjusting the yarn tension by hand.

The modification of FIG. 13 relates likewise to the region I of FIG. 2. In this embodiment, the roll 9 is supported on a slide which is movable in guideways parallel to the advancing yarn. The slide 24 is vertically adjustable by means of a spindle. As a result the looping angle changes. The special advantage of this embodiment is that the yarn path does not change as a result of the vertical adjustment of roll 9. Thus, also the frictional conditions on yarn guide 5 and yarn guide 4 which precede or respectively follow the feed system, remain constant.

As shown in this embodiment, the spindle can be rotated by hand. However, it is also possible to connect this spindle with a motor, and to operate the latter as a function of a tensiometer arranged upstream of the feed system in the direction of a downward movement and increase of the looping angle, when the yarn tension decreases, and in the direction of an upward movement and decrease of the looping angle, when the yarn tension increases. In this instance, it is possible to arrange the tension detector, for example, at the place or in the region of yarn guide 5 which precedes the feed system. This arrangement, also allows to change the looping angle alpha to a great extent, when the yarn tension changes little.

Figure 14:
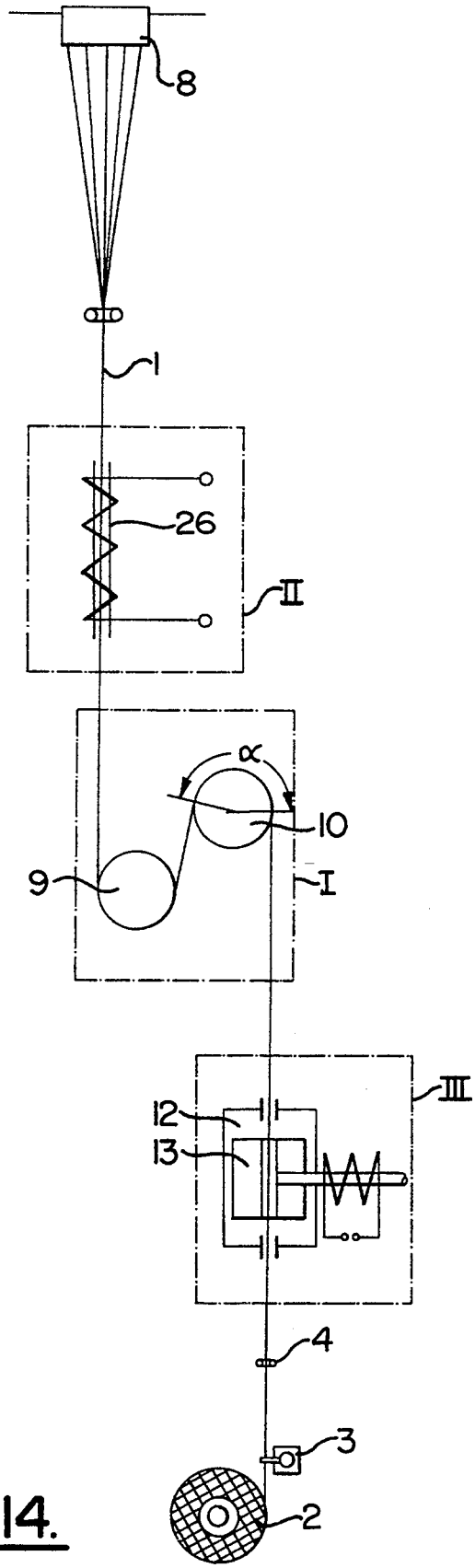
FIGS. 14 and 15 illustrate still further embodiments of the present invention.

FIG. 14 illustrates an especially suitable combination of the method, in that the yarn advancing from spinneret 8 is first combined and then heated in the region II in a heated tube 26. Such a heated tube is shown and described, for example, in DE-A 38 08 854. The heated tube is externally heated by an electric resistance to a temperature above 90° C. The heated tube is so narrow that the yarn assumes a corresponding temperature and is drawn as a result of its frictional resistance to the air and its plasticization in the heated tube. In the heated tube, the yarn undergoes a complete or at least a partial drawing.

The yarn is withdrawn by feed system 7 from the region II encompassing heated tube 26, which is subject matter of the present invention, and then advanced to the region III, where it is treated in a vapor chamber 12 as shown in FIG. 5. As a result of this treatment, the shrinkage tendency of the yarn is decreased. This is possible, because the yarn passes through the feed system of the present invention under very little tension, and a considerable shrinkage is thereby caused in combination with the treatment in the vapor nozzle. As a result, the tendency to residual shrinkage is reduced to a tolerable measure, so that also yarn having a strong tendency to shrinkage, such as, for example, nylon yarns, can be processed and wound in this manner. It should be emphasized that a further feed system may be provided between the vapor treatment chamber and upstream of the yarn takeup device.

Figure 15:
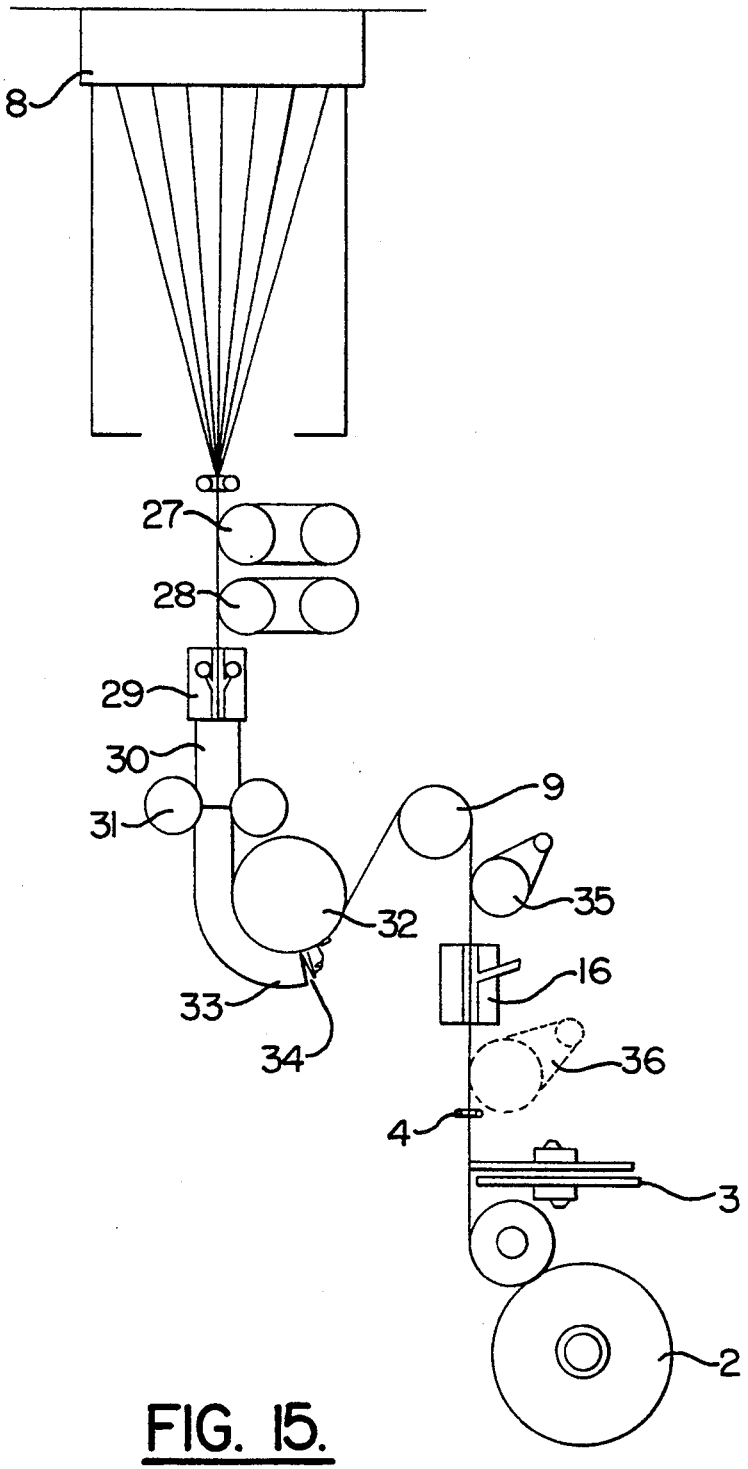

FIG. 15 illustrates an apparatus adapted for spin draw texturing the yarn with a simultaneous treatment by entanglement.

A bundle of filaments exits from spinneret 8, which is combined by a yarn guide. Then, the yarn advances via draw godets 27 and 28, at least one of which may be heated. The circumferential speed of the paired godets 28 is so great that the yarn is drawn between the two pairs of godets 27 and 28. Subsequently, the yarn advances to a hot air nozzle or hot vapor nozzle 29. In this hot air nozzle, the yarn is advanced by a hot air jet blown into the yarn duct, and thence into an adjacent tubular stuffer box 30. There, the yarn forms a plug 33. The air pressure at the inlet end of tubular stuffer box 30 causes the yarn to advance therethrough, and a pair of rolls 31 withdraw the yarn plug from the tubular stuffer box. The yarn plug then advances onto a cooling roll 32 and at least partially loops about same. The cooling roll 32 is rotated at a slow circumferential speed. It is porous, and an air current is sucked through the roll from the outside to the inside, thereby cooling the yarn plug 33. Subsequently, the yarn is again singled in that it is pulled out from the yarn plug. The point of exit is indicated at numeral 34, but it should be emphasized that the point of exit is not constant due to unavoidable irregularities of the yarn plug. Consequently, the tension of the advancing single yarn fluctuates.

To withdraw the yarn at the point of exit 34, a feed system 9 in accordance with the invention is used. In the illustrated embodiment, feed system 9 is looped at an angle of approximately 180°. The circumferential speed is more than 3% above the yarn speed. As a result, the yarn tension is very considerably reduced downstream of feed system 9, and the fluctuations of the yarn tension are substantially lessened. A looping feed system 35 may now follow, which is believed to result in a further steadying of the fluctuations in the yarn tension. It is however expected that in normal cases of application the feed system 9 of the present invention will suffice to achieve a uniform result in a subsequent entanglement nozzle 16, in which an air jet is blown onto the yarn transversely of its axis, which results in tangles at regular intervals. The tangles are in their shape and stability and in their intervals the more uniform, the more uniform the yarn tension. As shown in FIG. 15, a further looping feed system 36 may be arranged between yarn traversing system 3 and the entanglement nozzle. This looping feed system is intended to prevent the unavoidable fluctuations in the yarn tension, which develop in the traversing zone between stationary yarn guide 4 and the takeup package, from being transmitted into the entanglement zone. While this feed system is often advantageous to obtain a uniform entanglement result, it is unnecessary in many installations. The yarn advancing from the traversing system proceeds to the takeup package 2 via a guide roll.

In the drawings and specification, there has been set forth a preferred embodiment of the invention, and although specific terms are employed, they are used in a generic and descriptive sense only and not for purposes of limitation.

That which is claimed is:

1. A method of processing an advancing endless synthetic filament yarn, and comprising the steps of providing a yarn feed system which includes at least one rotating feed roll having a circumferential surface which defines a circumferential periphery, advancing the yarn into contact with the feed system, and including looping the advancing yarn about at least a portion of the circumferential periphery of said at least one rotating feed roll and so as to define a looping angle, selecting the looping angle of the advancing yarn about said at least one feed roll and a circumferential speed thereof such that the circumferential speed is greater than the speed of the yarn at the point it contacts said one feed roll, and such that the yarn slips with respect to the surface of said one feed roll and a frictional force is produced therebetween which is substantially speed independent, and withdrawing the advancing yarn from said feed system and winding the advancing yarn onto a rotatably driven tube to form a yarn package and including laterally traversing the advancing yarn along the length of the package and so as to form a traversing triangle which is located downstream of the yarn feed system.

2. The method as defined in claim 1 wherein the surface of said at least one rotating feed roll is characterized by a rough texture and the absence of grooves.

3. The method as defined in claim 2 wherein the selecting step includes looping the advancing yarn about said one feed roll at an overall looping angle of between about 90° and 270°.

4. The method as defined in claim 3 wherein the slip is at least about 3%.

5. The method as defined in claim 2 comprising the further step of moistening the advancing yarn at a location upstream of said feed system and such that the advancing yarn has a coefficient of friction which is less than about 0.4 with respect to the surface of said one feed roll.

6. The method as defined in claim 1 comprising the further step of contacting the advancing yarn with a feed godet at a location upstream of said feed system, with said feed godet having a surface speed which is substantially the same as or up to about 2% greater than the advancing speed of the yarn.

7. The method as defined in claim 1 wherein the advancing step includes withdrawing the yarn from a spinneret by said feed system and such that the yarn is at least partially drawn during advancing from said spinneret to said feed system.

8. The method as defined in claim 1 comprising the further step of subjecting the advancing yarn to at least an entanglement treatment or a shrinking treatment at a location upstream of said feed system.

9. The method as defined in claim 8 comprising the further step of subjecting the advancing yarn to a heating treatment while passing the yarn through a tube at a location upstream of said feed system.

10. The method as defined in claim 1 comprising the further step of subjecting the advancing yarn to at least an entanglement or shrinkage treatment, while heat treating the yarn, at a location upstream of said feed system.

11. The method as defined in claim 1 comprising the further step of passing the advancing yarn through a narrow heated tube at a location upstream of said feed system and so as to heat the advancing yarn to a temperature greater than about 90° C.

12. The method as defined in claim 1 wherein said feed system is located at a distance less than about three meters below a spinneret and said at least one roll of said feed system is rotated at a circumferential speed of at least about 6000 m/min.

13. The method as defined in claim 1 comprising the further step of subjecting the advancing yarn to a shrinkage treatment at a location upstream of said feed system, and including directing a hot vapor into contact with the advancing yarn.

14. A method of forming and processing an advancing endless synthetic filament yarn, and comprising the steps of withdrawing a plurality of synthetic filaments from a spinneret and collecting the withdrawn filaments to form a yarn, and while advancing the yarn along a path of travel, drawing the advancing yarn, texturizing the advancing yarn at a location downstream of the drawing step, guiding the advancing yarn into contact with a feed system at a location downstream of said texturizing step, with said feed system including at least one rotating feed roll having a circumferential surface which defines a circumferential periphery, and including looping the advancing yarn about at least a portion of the circumferential periphery of said at least one rotating feed roll and so as to define a looping angle, selecting the looping angle of the advancing yarn about said at least one feed roll and a circumferential speed thereof such that the circumferential speed is greater than the speed of the yarn at the point it contacts said one feed roll, and such that the yarn slips with respect to the surface of said one feed roll and a frictional force is produced therebetween which is substantially speed independent, and withdrawing the advancing yarn from said feed system and winding the advancing yarn onto a rotatably driven tube to form a yarn package and including laterally traversing the advancing yarn along the length of the package and so as to form a traversing triangle which is located downstream of the yarn feed system.

15. The method as defined in claim 14 wherein the surface of said at least one rotating feed roll is characterized by a rough texture and the absence of grooves.

16. The method as defined in claim 15 comprising the further step of looping the advancing yarn about a rotating feed godet at a location between said feed system and said traversing triangle and so as to advance the yarn without substantial slip.

17. The method as defined in claim 15 comprising the further step of air jet entangling the filaments of the advancing yarn at a location between said feed system and said traversing triangle.

18. The method as defined in claim 14 wherein the texturizing step includes passing the advancing yarn through a nozzle while directing a stream of heated air into contact with the advancing yarn in the nozzle, and then passing the advancing yarn into and through a tubular stuffer box at a location immediately downstream of said nozzle so as to form a yarn plug.

19. The method as defined in claim 18 comprising the further step of contacting the yarn plug with a rotating cooling roll at a location upstream of said feed system.

20. The method as defined in claim 14 wherein the yarn loops about the feed system at an overall looping angle which is between about 90° and 270°, and wherein the slip amounts to at least about 3%.

* * * * *